US005759289A

United States Patent [19]

Caron et al.

[11] Patent Number: 5,759,289

[45] Date of Patent: Jun. 2, 1998

[54] CENTRAL HEADER FOR LIQUID CLEANING UNITS

[75] Inventors: Daniel Caron, Beauport; Michel Froment, Charny; Daniel Giguere, St-Tite-des-Caps; Gaetan Pelletier, Beauport, all of Canada

[73] Assignee: Steris Corporation, Mentor, Ohio

[21] Appl. No.: 740,797

[22] Filed: Nov. 1, 1996

[51] Int. Cl.[6] ..... B08B 3/02

[52] U.S. Cl. ..... 134/34; 134/95.3; 134/172; 134/199

[58] Field of Search ..... 134/95.3, 123, 134/131, 129, 144, 151, 172, 199, 25.4, 26, 34

[56] References Cited

U.S. PATENT DOCUMENTS

| | | | |
|---|---|---|---|
| 2,305,811 | 12/1942 | Oeckl | 134/151 X |
| 3,289,238 | 12/1966 | Sorenson et al. | 134/123 X |
| 3,736,948 | 6/1973 | Crosswhite | 134/123 X |
| 4,295,730 | 10/1981 | Fraser | 134/151 X |
| 4,452,263 | 6/1984 | McClure | 134/45 |
| 4,848,383 | 7/1989 | Buhler | 134/199 X |
| 5,379,784 | 1/1995 | Nishi et al. | 134/199 X |

OTHER PUBLICATIONS

"Model 3500 Cage and Bottle Washer", Basil Advertising Brochure, Mar. 1992.

"Scientek Hospital and Laboratory Equipment", Advertising Brochure.

"General Specifications For Scientek Cage and Bottle Washer Model SW5500", Nicram International, Inc.

*Primary Examiner*—Philip R. Coe

*Attorney, Agent, or Firm*—Fay, Sharpe, Beall, Fagan, Minnich & McKee

[57] ABSTRACT

A washing chamber (10) is surrounded by corner manifolds (14) and interconnecting conduits (16) extending along top, bottom, and side walls of the washing chamber. The conduits have nozzles (12) therein for spraying washing and rinsing liquids into the washing chamber. A central header assembly (40) includes a conduit (42) extending from one of the headers to a terminal end adjacent a central plane of the washing chamber. The central header assembly includes a header (46) with a manifold portion (48) and a plurality of extending arms (50) with nozzles on opposite sides. The header manifold portion is connected with the terminal end of the conduit (42). In one embodiment, a pivotal fluid connection and valve (44) enables the header to pivot between a position in the vertical plane and a stowed position parallel to the top of the washing chamber. In another embodiment, a quick-connect coupler system (100) interconnects the header with an outlet at the terminal end of the conduit (42).

20 Claims, 3 Drawing Sheets

CENTRAL HEADER FOR LIQUID CLEANING UNITS

BACKGROUND OF THE INVENTION

The present invention relates to the cleaning and decontaminating arts. It finds particular application in conjunction with washers for washing laboratory, veterinary, medical appliances, and the like. It is to be appreciated that the invention will also find application in conjunction with sanitizing and disinfecting equipment of various types.

There are many different sizes of washers particularly adapted for washing a multiplicity of appliances and devices. When cleaning animal cages, pans, and other large items, a washer with a capacity of about a cubit meter is commonly employed. More specifically, the washing chamber is surrounded with several rectangular rings of spray nozzles. The devices to be washed are loaded in racks which are then slid or rolled into the washing chamber through a front access port. During the washing cycle, water and cleaning solutions are sprayed from the top, bottom, and both sides by a ring of nozzles.

One of the drawbacks to such washers occurs when they are used to wash large, but thin items such as pans or trays. If a large tray is positioned vertically on each side of the washer, the trays shield each other from the spray nozzles. That is, with two trays positioned with one side facing each other and their opposite sides facing the spray nozzles, the outward facing side of one tray towards the spray nozzle prevents sprayed water from reaching the inward facing side of the other tray. To achieve assured cleaning, typically only a single tray or line of trays are washed at a time. This assures that both sides of the trays receive the full spray action. However, a large area within the washer is left empty, causing a decreased washing efficiency.

The present invention provides a new and improved construction which overcomes the above-referenced problems and others.

SUMMARY OF THE INVENTION

In accordance with one aspect of the present invention, a header assembly is provided for connection to a washer generally centrally in the washing chamber. The header includes a conduit which is connectable with a plumbing system of the washer. A header connects with the conduit. The header includes a plurality of nozzles disposed to spray from generally centrally in the washing chamber towards opposite sides of the washing chamber.

In accordance with another aspect of the present invention, a central header assembly is provided for a washer. The washer includes manifolds disposed adjacent upper and lower portions of the washing chamber and a plurality of conduits extending between the manifolds parallel to upper, lower, and side surfaces of the washing chamber. A plurality of nozzles are disposed in the conduits for spraying washing liquid into the washing chamber. A drain at the bottom of the washing chamber returns the washing liquid to a reservoir. A pump recirculates the washing liquid from the reservoir to the conduits and nozzles. The central header includes a conduit which is connected with one of the manifolds which is disposed adjacent an upper portion disposed adjacent an upper portion of the washing chamber. The conduit extends parallel to the conduits extending across the upper surface of the washing chamber and has a terminal end near a generally central plane of the washing chamber. A connection assembly connects the conduit to the manifold. A central header is connected with the terminal end. The central header includes a plurality of nozzles disposed to spray the washing liquid to opposite sides of the central plane to spray from the central plane of the washing chamber outward.

In accordance with another aspect of the present invention, a washer is provided. A plurality of nozzles are disposed around a washing chamber for spraying a washing and rinsing liquid into the washing chamber. Conduits supply the washing and rinsing liquid to the nozzles. A drain at the bottom of the washing chamber returns the washing and rinsing liquid to a reservoir. A pump recirculates the washing and rinsing liquid from the reservoir to the conduits and nozzles. A central header is selectively disposable along a vertical plane of the washing chamber and is selectively removable from the vertical plane. The central header includes a plurality of conduits with nozzles disposed therein. In the vertical plane, the conduits are connected with the pump for spraying the washing and rinsing liquid from the vertical plane into the washing chamber.

In accordance with another aspect of the present invention, a method of washing is provided. A central header is positioned along a generally central vertical plane of a washing chamber. The central header has spray nozzles on opposite sides. Items to be washed are inserted on either side of the header. Wash and rinse liquids are sprayed from a plurality of nozzles disposed along top, bottom, and side walls of the washing chamber and from nozzles on opposite sides of the central header. In this manner, items on either side of the central header are sprayed from both sides, top, and bottom. The spraying is terminated and the items are removed from the washing chamber.

In accordance with a more limited aspect of the present invention, the step of positioning the central header along the vertical axis includes pivoting the central header from a stowed position parallel to the top wall of the washing chamber to the vertical plane.

One advantage of the present invention resides in the increased washer throughput.

Another advantage of the present invention resides in its improved cleaning and superior spray action.

Another advantage of the present invention is that it increases the capacity of existing washers.

Another advantage of the present invention is that it reduces washing chemical consumption and cost.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
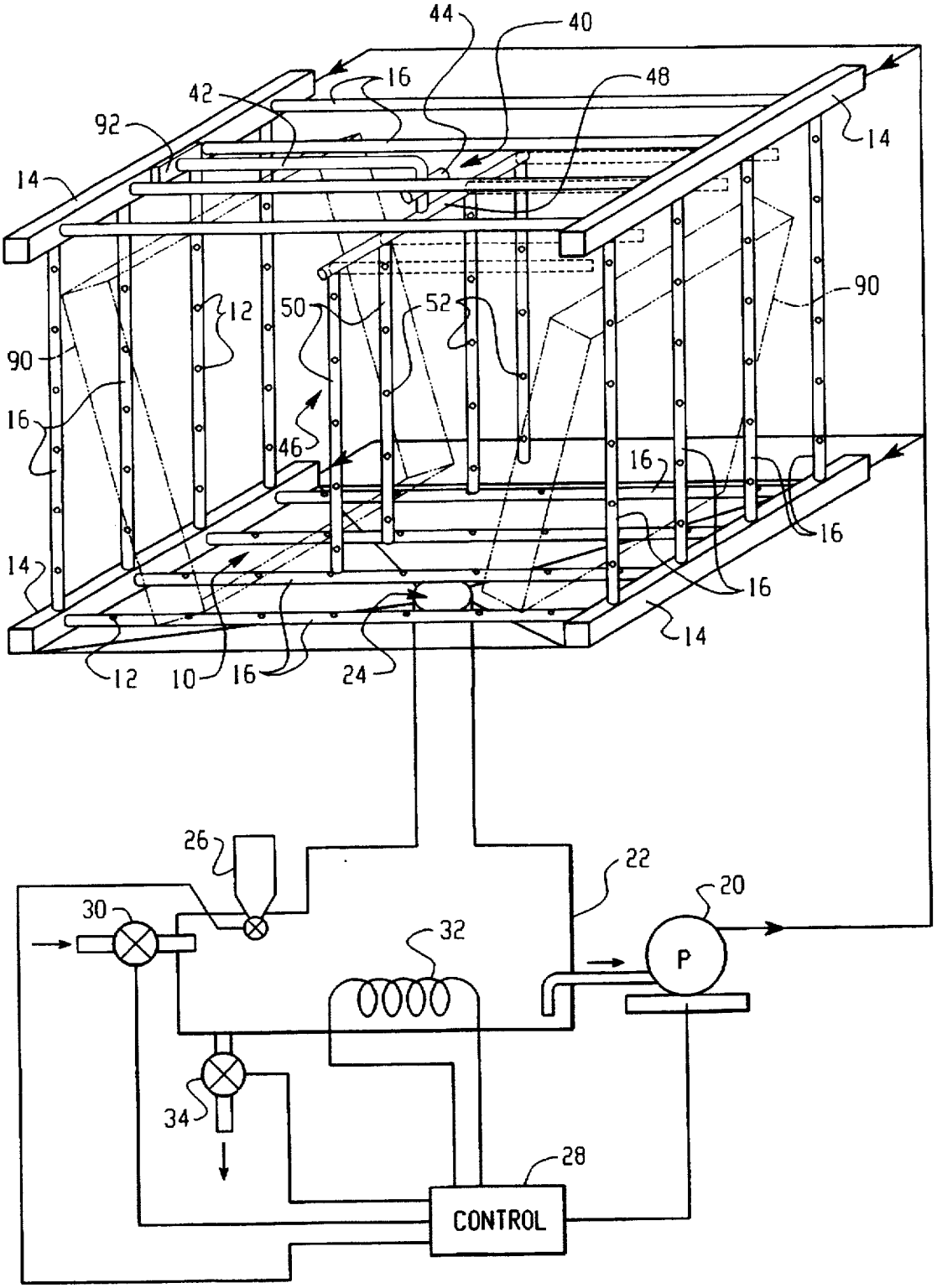
FIG. 1 is a perspective view of a diagrammatic washer in accordance with the present invention.

With reference to FIG. 1, a washing chamber 10 is surrounded by a multiplicity of spray nozzles 12. More specifically, the washing chamber is a rectangular prism having four corner manifolds 14. A plurality of conduits 16 extend between the corner manifolds. The spray nozzles 12 are defined by apertures in the conduits or by discrete spray nozzles tapped into apertures in the conduits.

The four corner manifolds are connected with a pump 20 that pumps washing and rinsing fluids from a reservoir 22, such as a sump or tank. The wash and rinse fluids are pumped through the manifolds, the conduits, and the nozzles to spray pressurized jets of washing and rinsing fluids into the washing chamber 10. The fluids fall to the bottom of the chamber and are channeled by a drain 24 back to the reservoir 22. One or more additive dispensers 26 are connected with the reservoir 22 for dispensing detergents, wetting agents, soaps, disinfectants, and the like into the fluid in the reservoir. A control circuit 28 controls the pump 20, the dispenser 26, a water inlet 30, a heater 32, and a drain 34. The control 28 controls filling, draining, the temperature of the liquid, and the additives within the liquid, as well as the pumping and liquid circulation cycles.

Figure 2:
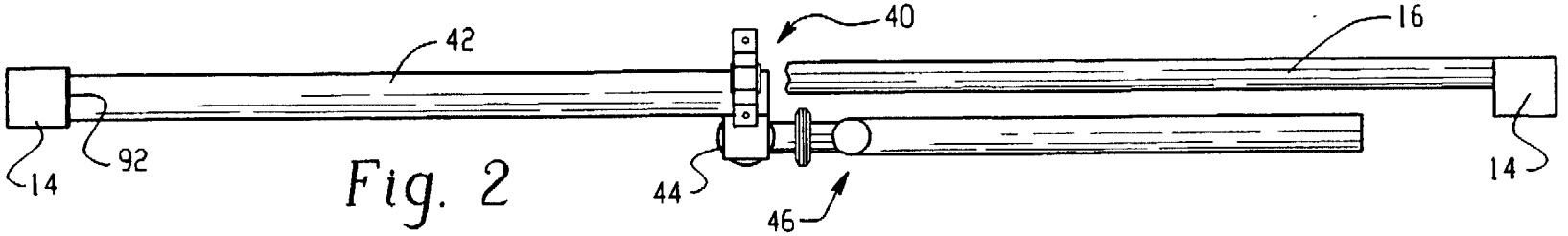
FIG. 2 is a side view of the central header assembly of FIG. 1.
Figure 3:
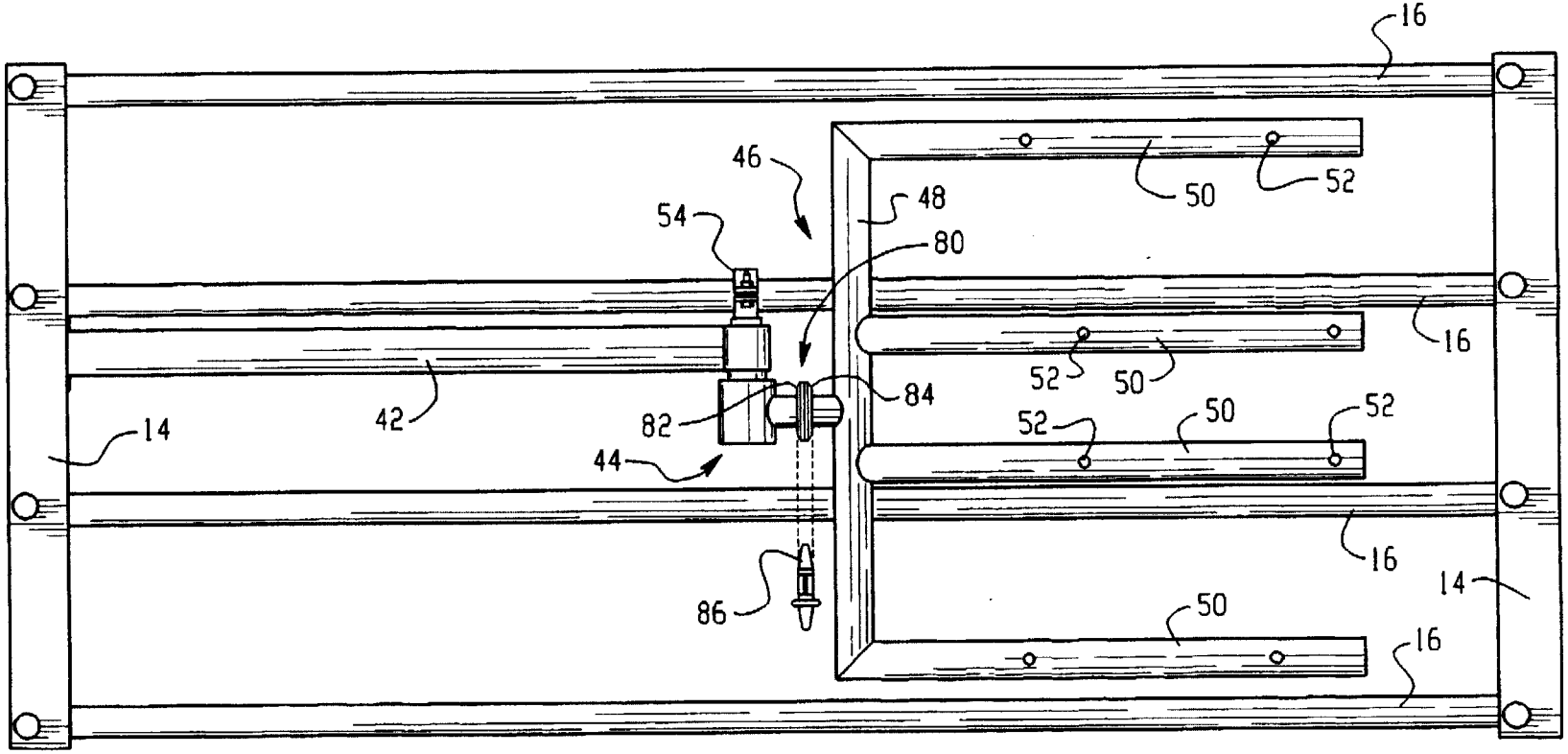
FIG. 3 is a plan view of the central header of FIG. 1 in the stowed position in combination with upper washing conduits and manifolds looking from the washing chamber up.

With continuing reference to FIG. 1 and particular reference to FIGS. 2 and 3, a central header assembly 40 is selectively disposable along a central, or other, preselected plane of the washing chamber. In the preferred embodiment, a feed tube 42 is connected with one of the corner manifolds 14 and extends parallel to upper conduits 16. Adjacent the central plane, the feed tube jogs down to a pivot element 44 which pivotally mounts a central spray header 46. More specifically, the central spray header 46 includes a connecting or manifold portion 48 and a plurality of depending arms 50. Each of the arms includes a conduit with a plurality of spray nozzles 52 on opposite sides thereof. In the out-of-use position (phantom in FIG. 1), the central spray assembly 46 lays parallel to the upper conduits with the spray header arms disposed offset from the upper conduits. In this manner, the spray header conduits do not block the spray nozzles 12 of the upper conduits. In the active, washing position, the central header pivots down into a vertical plane, with its spray nozzles aiming towards opposite sides. A clamp 54 is provided for clamping the conduit 42 with one of the top conduits 16 adjacent the pivot 44.

Figure 4:
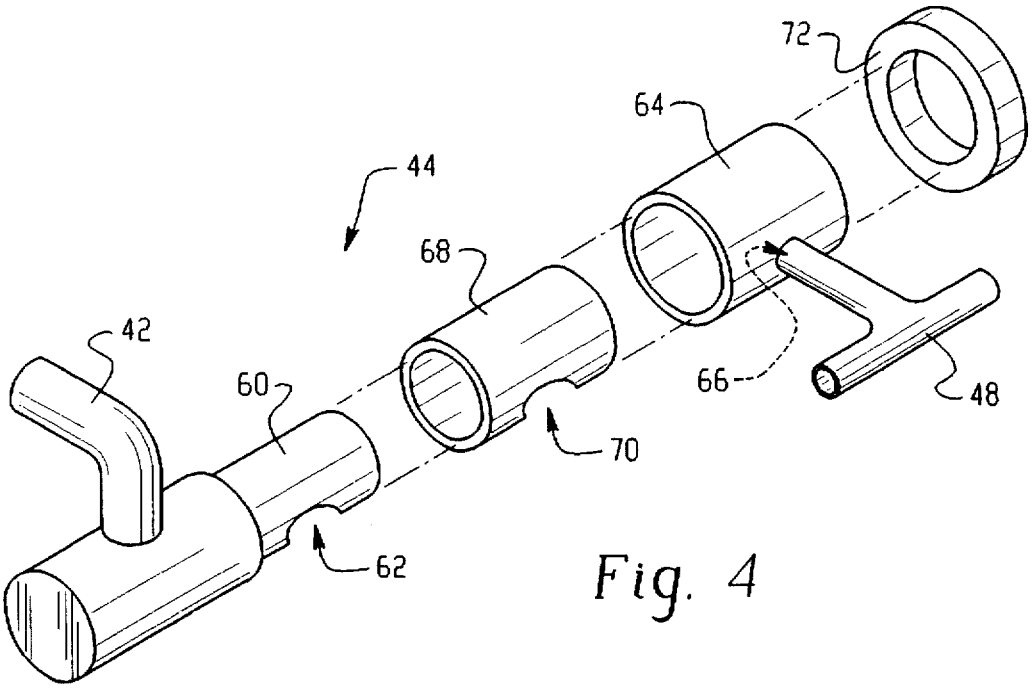
FIG. 4 is an expanded view illustrating the pivot/shutoff valve assembly.

With reference to FIG. 4, the pivot 44 in the preferred embodiment is also a valve which prevents liquids from flowing to the central spray header 16 in the stowed position and permits water to flow to the central spray header in the vertical position. The preferred pivot/valve 44 includes a horizontally disposed cylindrical shaft 60 connected with the tube 44. The central shaft has an outlet aperture 62 on a lower face thereof. The central spray header 46 has an upper cylindrical element 64 which is sized to fit over the cylindrical member 60. The cylindrical element 64 has an aperture 66 in one side thereof to provide fluid communication with the manifold portion 48. A plastic element 68 having an aperture 70 is disposed between the cylindrical members 60 and 64 to provide a sealing and bearing surface. The plastic cylindrical member is affixed to one of the cylindrical members 60 or 64 with their apertures aligned. An end gasket assembly 72 helps prevent the leakage of washing fluids, which leakage would reduce pressure at the central spray head. In this manner, when the central spray head is in the stowed position, the apertures 62, 66 are out of alignment and when the central spray head is in the vertical orientation, these apertures are in alignment.

With reference to FIGS. 2 and 3, for easy cleaning, a quick-disconnect coupling 80 is provided. More specifically to the preferred embodiment, the quick-disconnect coupling includes a pair of mating flanges 82, 84. A ring with a screw clamp 86 extends around the two flanges to connect them firmly together. Of course, other easy to connect and release couplings are also contemplated.

With reference again to FIG. 1, in operation, the central header is positioned in the stowed position (illustrated in phantom in FIG. 1) when large items to be washed are placed in the center of the washing chamber 10. When pans or trays 90 (illustrated in phantom in FIG. 1) are to be washed, the central header assembly 40 is turned to the vertical position. The control circuit 28 causes the pump 20 to circulate a prewash rinse solution from the reservoir 22 through the manifolds and conduits and out the nozzles 12, 52. The initial rinse water is then drained 34 and the reservoir 22 refilled 30 with water. The water is heated with the heater 32 and mixed with appropriate washing, decontamination, or disinfection chemicals from the dispenser 26. The pump 20 then circulates the wash liquid to the spray nozzles spraying down the washed items with the wash liquid being recollected in the reservoir 22. After the wash cycle, the reservoir is drained and refilled with clean rinse water. Optionally, chemicals can be added to the rinse water to reduce spotting or the like. The pump then circulates the rinse water to the nozzles and collects it through the drain in the reservoir 22. At the end of the wash cycle, the rinse water may be drained or retained to use as the prewash rinse in the next cycle.

The present central header assembly is amenable to being added to existing washers. In a retrofit process, a technician drills a bore into one of the manifolds 14. The arm 42 has a flange 92 at its mounting end. A gasket is mounted between the manifold and the flange 92. The flange 92 is anchored to the manifold 14 with machine screws, clamps, or other suitable connection mechanisms.

Figure 5:
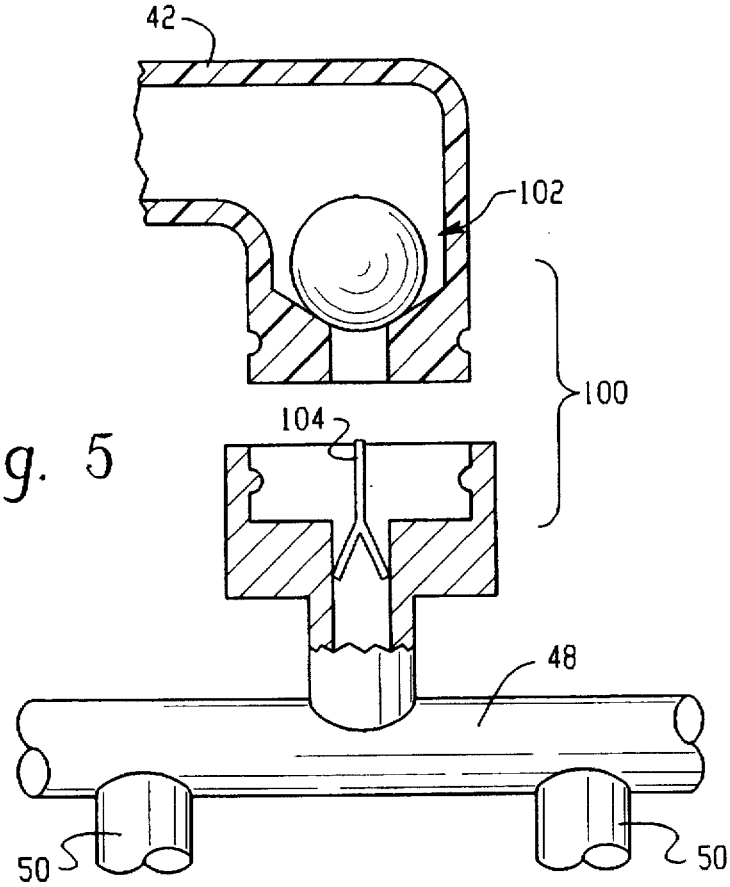
FIG. 5 illustrates an alternate embodiment of the assembly of FIG. 4.

With reference to FIG. 5, rather than being pivoted, the central header 40 can be inserted in the vertical position and removed rather than being stowed. Various quick-connect couplings, such as a bayonet coupling 100, a snap coupling, or the like, are contemplated. Optionally, the arm 42 terminated with a valve 102, such as a sphere and conical seat, which seals the outlet when the central arm is removed. A projection 104 on the bayonet or other coupling lifts the ball off the seat when the central header is connected.

Rather than a single fitting and a manifold arm 46, each of the central header spray arms 48 can be separately connectable and disconnectable. For example, quick-connect fittings as illustrated in FIG. 5 can be positioned midway or at other selected positions along the upper conduits 16. Each of the central spray conduits has a bayonet or other quick-connect fitting 100 mounted to its upper end. Having individually connectable and disconnectable central header spray systems provides additional pattern flexibility. Rather than having quick-connect couplers mounted only along the central plane of the upper conduits 16, quick-disconnect couplers can be positioned at various positions along their length. For example, two sets of arms can be connected one third and two thirds of the way along the conduit to accommodate three trays. Such quick-connect fittings may also be placed along the side or bottom conduits as well. As yet another option, the central header can be mounted on a slide cart or rack and connected with one of the manifolds 14 or otherwise connected with the pump 20 using a flexible conduit.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A washer including a plurality of nozzles disposed around a washing chamber for spraying a washing and rinsing liquid into the washing chamber, conduits for supplying the washing and rinsing liquid to the nozzles, a drain at the bottom of the washing chamber for returning the washing and rinsing liquid to a reservoir, a pump for recirculating the washing and rinsing liquid from the reservoir to the conduits and nozzles, the washer further comprising:

a central header which is selectively disposable along a vertical plane of the washing chamber and which is selectively removable from the vertical plane, the central header including a plurality of conduits with nozzles disposed therein, in the vertical plane, the conduits being interconnected with the pump for spraying the washing and rinsing liquid from the vertical plane into the washing chamber.

2. The washer as set forth in claim 1, further including a pivot which pivotally connects the central header adjacent a central, upper portion of the washing chamber such that the central header is pivotal between the vertical plane and a stowed position generally parallel to and adjacent an upper surface of the washing chamber.

3. The washer as set forth in claim 2 further including a liquid flow valve disposed in association with the pivot, the valve passing the liquid to the central header when the central header is disposed in the vertical plane and blocking the liquid from flowing to the central header in the stowed position.

4. The washer as set forth in claim 1 wherein the central header includes a central manifold portion and a plurality of arms extending therefrom, each of the arms including a plurality of nozzles disposed on opposite sides thereof.

5. The washer as set forth in claim 4 further including:

a fluid outlet disposed generally centrally on an upper side of the washing chamber;

a quick-connect coupling assembly having a first portion associated with the centrally disposed outlet and a second portion associated with the central header manifold portion such that the central header is selectively connectable and disconnectable from the centrally disposed outlet.

6. The washer as set forth in claim 5 further including a valve associated with the quick-connect coupling assembly for passing the washing and rinsing liquid through the centrally disposed outlet when the central header is connected and blocking the passage of the washing and rinse liquid when the central header is disconnected.

7. The washer as set forth in claim 1 further including:

at least one manifold disposed adjacent an upper corner of the washing chamber, the washing conduits being interconnected with the manifold and running at least along an upper side of the washing chamber;

a conduit connected with the manifold and extending along the upper side of the washing chamber and having a terminal end adjacent a central vertical plane of the washing chamber, the central header being connected with the terminal portion.

8. The washer as set forth in claim 7 further including a quick-connect/disconnect coupler system for selectively interconnecting the central header and the terminal end.

9. The washer as set forth in claim 7 further including a pivot interconnecting the terminal end and the central header.

10. A central header assembly for a washer which includes manifolds disposed adjacent upper and lower portions of the washing chamber, a plurality of conduits extending between the manifolds parallel to upper, lower, and side surfaces of the washing chamber, a plurality of nozzles disposed in the conduits for spraying a washing liquid into the washing chamber, a drain at the bottom of the washing chamber for returning the washing liquid to a reservoir, a pump for recirculating the washing liquid from the reservoir to the conduits and nozzles, the central header comprising:

a conduit which is connectable with one of the manifolds disposed adjacent an upper portion of the washing chamber and extending parallel to conduits extending across the upper surface of the washing chamber and having a terminal end near a generally central plane of the washing chamber;

a connection assembly for connecting the conduit to the manifold;

a central header connected with the terminal end, the central header including a plurality of nozzles disposed to spray the washing liquid to the central plane to spray from the central plane of the washing chamber outward.

11. The central header assembly as set forth in claim 10 further including:

a quick-connect/disconnect coupling interconnecting the central header with the terminal end.

12. The central header assembly as set forth in claim 10 further including:

a central header manifold with a plurality of conduits extending therefrom with nozzles on opposite sides of the conduits, the manifold being connected with the terminal end.

13. The central header assembly as set forth in claim 12 further including:

a quick-connect/disconnect coupling system which interconnects the central header manifold with the terminal end.

14. The central header assembly as set forth in claim 10 further including:

a pivotal fluid connection interconnecting the terminal end and the central header such that the central header is pivotable between a stowed position parallel to the conduits extending along the top of the washing chamber and extending along the vertical plane.

15. The central header assembly as set forth in claim 14 wherein: the central header includes a plurality of arms which are offset from the conduits extending along the upper surface of the washing chamber such that the arms do not interfere with nozzles in the conduits along the upper surface of the washing chamber.

16. The central header assembly as set forth in claim 14 further including:

a valve associated with the pivotal fluid connection, which valve blocks the flow of fluid when the central header is pivoted to the stowed position and permits the passage of the washing liquid when the central header is disposed in the vertical plane.

17. A header assembly for connection to a washer in a washing chamber, the header comprising:

a conduit which is connectable with a plumbing system of the washer;

a header for connection with the conduit, the header including a plurality of nozzles disposed to spray from generally centrally in the washing chamber toward opposite sides of the washing chamber;

a pivotal fluid connection interconnecting the conduit and the header such that the header is pivotable between (i) a stowed position parallel to a top of the washing chamber and (ii) a washing position extending along the vertical plane; and a valve associated with the pivotal fluid connection, which valve blocks the flow of fluid when the header is pivoted to the stowed position and permits the passage of the washing liquid when the central header is disposed in the washing position.

18. A method of washing which includes a plurality of nozzles disposed around a washing chamber for spraying a washing and rinsing liquid into the washing chamber, conduits for supplying the washing and rinsing liquid to the nozzles, a drain at the bottom of the washing chamber for returning the washing and rinsing liquid to a reservoir, a pump for recirculating the washing and rinsing liquid from the reservoir to the conduits and nozzles, the method comprising:

positioning a central header along a generally central vertical plane of a washing chamber, the central header having spray nozzles on opposite sides thereof;

inserting items to be washed on either side of the header;

spraying wash and rinse liquids from the plurality of nozzles disposed along top, bottom, and side walls of the washing chamber and from the nozzles on opposite sides of the central header such that the items to either side of the central header are sprayed from both sides, top, and bottom;

terminating the spraying and removing the items from the washing chambers removing the central header from the central vertical plane of the washing chamber;

inserting a large item to be washed in the washing chamber, said large item passing through at least a part of the vertical plane which had been occupied by the central header;

spraying wash and rinse liquids from the plurality of nozzles disposed along the top, bottom, and side walls of the washing chamber;

terminating the spraying and removing the large item from the washing chamber.

19. The method as set forth in claim 18 wherein the step of positioning the central header along the vertical plane includes pivoting the central header from a stowed position parallel to the top wall of the washing chamber to the vertical plane.

20. The method as set forth in claim 18 wherein the step of positioning the central header in the vertical plane includes connecting the central header to an outlet disposed in the upper surface of the washing chamber with a quick-connect/disconnect coupling system.

* * * * *